US009478927B1

(12) United States Patent
Shen

(10) Patent No.: US 9,478,927 B1
(45) Date of Patent: Oct. 25, 2016

(54) EXPANDABLE POWER ADAPTOR

(71) Applicant: YANG JI CO., LTD., New Taipei (TW)

(72) Inventor: Su-Chen Shen, New Taipei (TW)

(73) Assignee: YANG JI CO., LTD., New Taipei (TW)

( * ) Notice: Subject to any disclaimer, the term of this patent is extended or adjusted under 35 U.S.C. 154(b) by 0 days.

(21) Appl. No.: 14/698,850

(22) Filed: Apr. 29, 2015

(51) Int. Cl.

| | |
|---|---|
| ***H01R 13/514*** | (2006.01) |
| ***H01R 27/02*** | (2006.01) |
| ***H01R 25/00*** | (2006.01) |
| ***H01R 24/60*** | (2011.01) |
| ***H01H 23/24*** | (2006.01) |
| *H01R 107/00* | (2006.01) |

(52) U.S. Cl.
CPC ..... *H01R 27/02* (2013.01); *H01H 23/24* (2013.01); *H01R 24/60* (2013.01); *H01R 25/006* (2013.01); *H01R 2107/00* (2013.01)

(58) Field of Classification Search
CPC ..... H01R 13/6658; H01R 13/514; H01R 439/701; H01R 439/928
USPC ..... 439/76.1, 701, 928
See application file for complete search history.

(56) References Cited

U.S. PATENT DOCUMENTS

| | | | | | |
|---|---|---|---|---|---|
| 4,392,701 | A * | 7/1983 | Weidler | H01R 31/02 | 439/405 |
| 4,401,351 | A * | 8/1983 | Record | H01R 23/68 | 361/688 |
| 5,108,313 | A * | 4/1992 | Adams | H01R 13/514 | 439/607.47 |
| 5,658,158 | A * | 8/1997 | Milan | H01R 13/514 | 439/214 |
| 5,718,562 | A * | 2/1998 | Lawless | A61M 5/1413 | 361/730 |
| 5,883,785 | A * | 3/1999 | Rohrbeck | F15B 13/0807 | 137/884 |
| 6,081,048 | A * | 6/2000 | Bergmann | H05K 7/1472 | 307/147 |
| 6,220,872 | B1 * | 4/2001 | Chen | H01R 31/065 | 439/76.1 |
| 8,632,347 | B2 * | 1/2014 | Chen | H01R 13/453 | 439/137 |
| 2001/0027066 | A1 * | 10/2001 | Loh | H01R 13/514 | 439/701 |
| 2004/0171312 | A1 * | 9/2004 | Sichner | H01R 13/514 | 439/701 |
| 2004/0214476 | A1 * | 10/2004 | Haas | H01R 13/514 | 439/701 |
| 2005/0170676 | A1 * | 8/2005 | Yuan | H02J 7/0042 | 439/76.1 |

* cited by examiner

*Primary Examiner* — Gary Paumen
(74) *Attorney, Agent, or Firm* — Leong C. Lei

(57) ABSTRACT

The expandable power adaptor contains a first casing member, a second casing member, a circuit assembly, and at least a metallic connector. The first casing member has a first coupling element set. The second casing member has a second coupling element set. The first and second casing members are joined to form an enclosed accommodation space. The circuit assembly and the metallic connectors electrically connected to the circuit assembly are configured in the accommodation space. To assembly, the first lower piece and the second lower piece are joined to form a complete lower piece. Then the circuit assembly and the metallic connectors are configured on the complete lower piece, and the first and second upper pieces are vertically joined to the first and second lower pieces. Additional casing members can be integrated between the first and second casing members so as to achieve the desired number of outlets.

8 Claims, 10 Drawing Sheets

EXPANDABLE POWER ADAPTOR

BACKGROUND OF THE INVENTION (a) Technical Field of the Invention

The present invention is generally related to power adaptors, and more particular to a modularized and flexibly expandable power adaptor.

(b) Description of the Prior Art

Power adaptors are common household appliances. There are various types of power adaptors from the 1-to-1 adaptors (i.e., extension cords) to those with multiple outlets (e.g., a 1-to-3 adaptor).

For manufacturers, to produce power adaptors of a specific number of outlets requires a specific set of molds. Therefore, to produce 1-to-3 adaptors requires a first set of molds whereas to produce 1-to-4 adaptors requires a second set of molds. As such, to produce adaptors of various numbers of outlets involves a significant number of sets of molds, contributing to the increase of production cost.

Adaptors of various numbers of outlets actually have quite some common parts. For example, their two ends and the internal circuits are usually identical. The difference mainly lies in the middle section of the adaptors.

SUMMARY OF THE INVENTION

A major objective of the present invention is to provide an expandable and modularized power adaptor where different number of outlets can be achieved by joining standardized modules, thereby providing enhanced flexibility To achieve the objective, the expandable power adaptor contains a first casing member, a second casing member, a circuit assembly, and at least a metallic connector. The first casing member has a first coupling element set on an inner wall of the first casing member. The second casing member has a second coupling element set on an inner wall of the second casing member. The first and second casing members are joined to form an enclosed accommodation space. The circuit assembly and the metallic connectors electrically connected to the circuit assembly are configured in the accommodation space.

To assembly, the first lower piece and the second lower piece are joined to form a complete lower piece through the locking between the first and second lower coupling elements. Then the circuit assembly and the metallic connectors are configured on the complete lower piece. Then, the first and second upper pieces are vertically joined to the first and second lower pieces. To expand the number of outlets, one or more casing members can be integrated between the first and second casing members, along with the additional metallic connectors.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
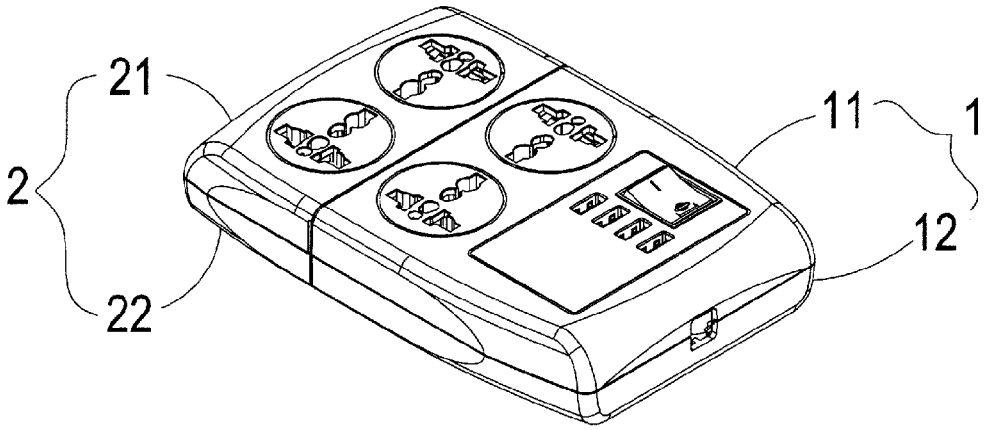
FIG. 1 is a perspective diagram showing an expandable power adaptor according to an embodiment of the present invention.
Figure 2:
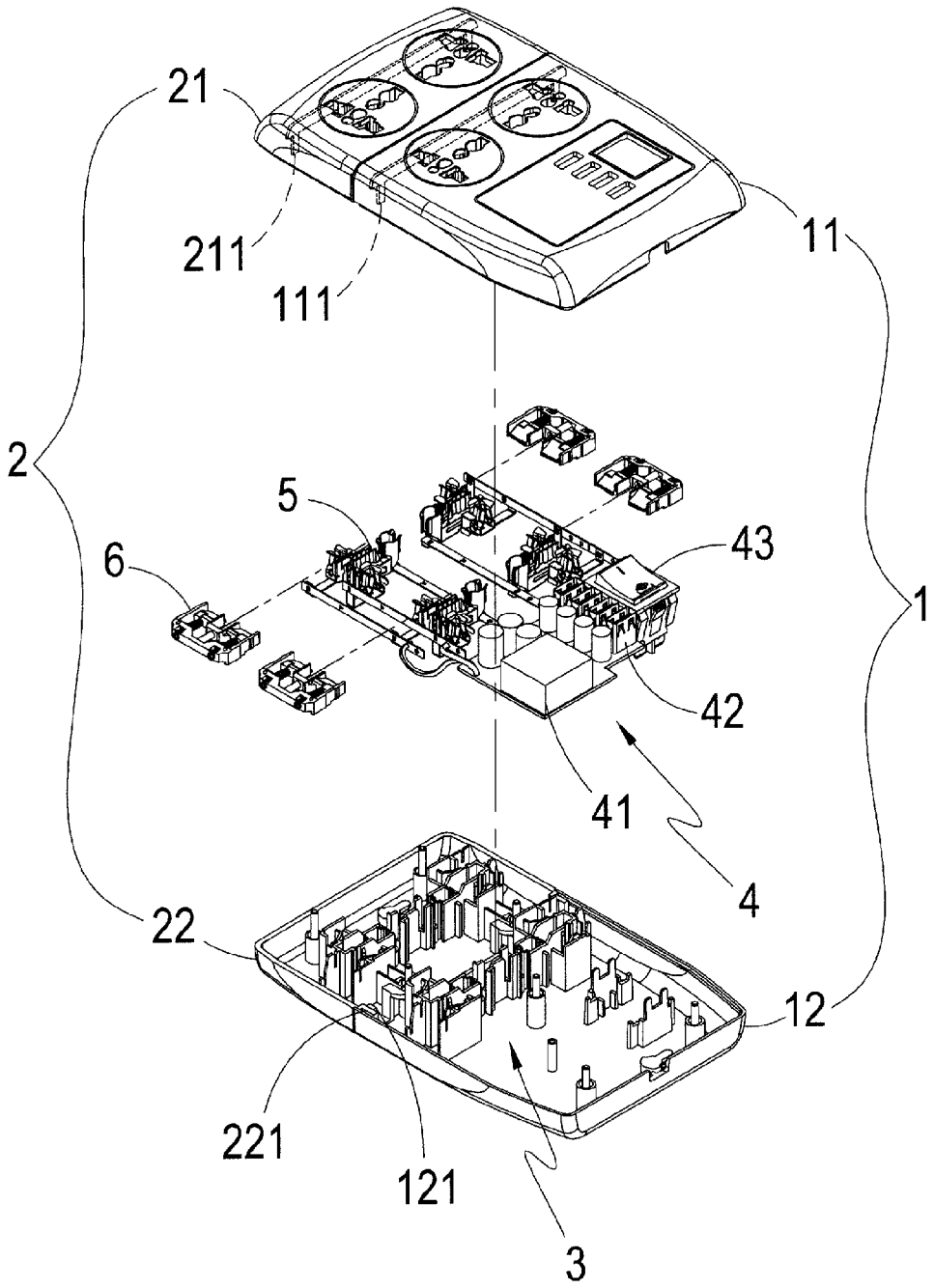
FIG. 2 is a perspective break-down diagram showing the various components of the expandable power adaptor of FIG. 1.
Figure 3:
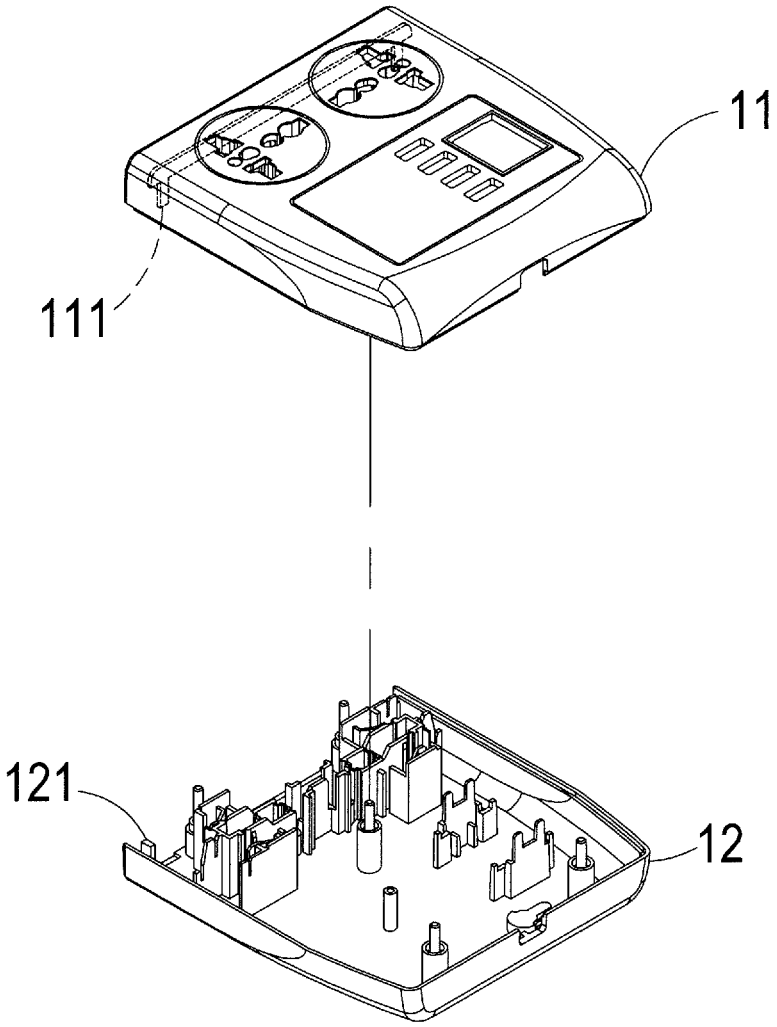
FIG. 3 is a perspective break-down diagram showing a first casing member of the expandable power adaptor of FIG. 1.
Figure 4:
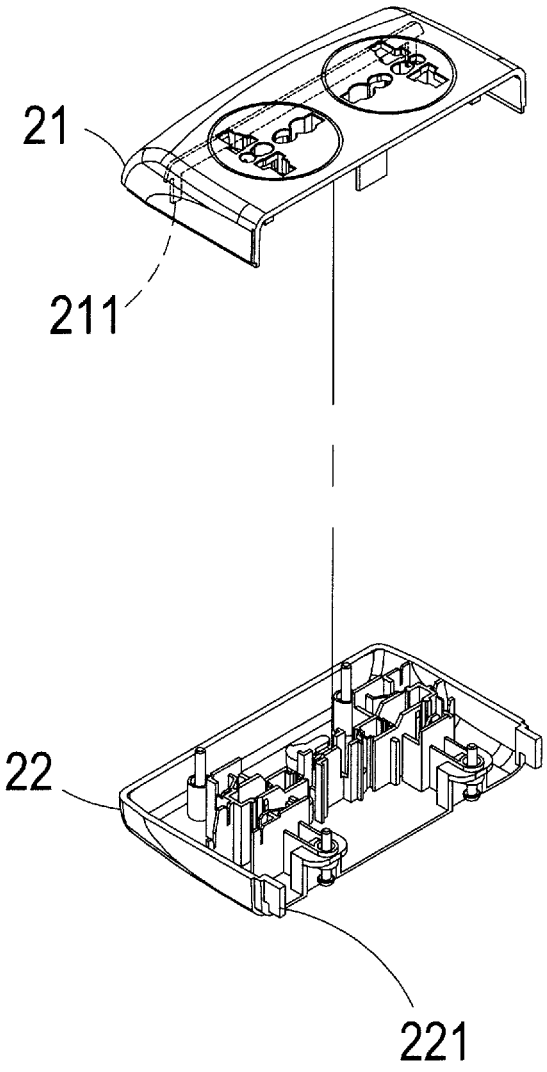
FIG. 4 is a perspective break-down diagram showing a second casing member of the expandable power adaptor of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 4, an expandable power adaptor according to an embodiment of the present invention contains the following components.

There is a first casing member 1 having a first coupling element set on an inner wall of the first casing member 1.

There is a second casing member 2 having a second coupling element set on an inner wall of the second casing member 2. The first and second casing members 1 and 2 are joined to form an enclosed accommodation space 3.

There is a circuit assembly 4 in the accommodation space 3.

There are metallic connectors 5 in the accommodation space 3 and electrically connected to the circuit assembly 4.

The first casing member 1 contains a first upper piece 11 and a corresponding first lower piece 12 joined vertically together. The first upper piece 11 has at least a first upper coupling element 111 on an inner wall of the first upper piece 11. The first lower piece 12 has at least a first lower coupling element 121 on an inner wall of the first lower piece 12. The first upper and lower coupling elements 111 and 121 jointly constitute the first coupling element set. The first upper and lower pieces 11 and 12 are locked together through at least a bolt element.

The second casing member 2 contains a second upper piece 21 and a corresponding second lower piece 22 joined vertically together. The second upper piece 21 has at least a second upper coupling element 211 on an inner wall of the second upper piece 21. The second lower piece 22 has at least a second lower coupling element 221 on an inner wall of the second lower piece 22. The second upper and lower coupling elements 211 and 221 jointly constitute the second coupling element set. The second upper and lower pieces 21 and 22 are locked together through at least a bolt element.

The circuit assembly 4 contains a power conversion module 41, at least a Universal Serial Bus (USB) port 42 electrically connected to the power conversion module 41, and at least a switch 43 for turning on and off the power conversion module 41. There is also at least a movable element 6 inside the accommodation space 3 corresponding to a metallic connector 5 to prevent accidentally plugging something into an outlet and contacting the metallic connector 5.

As described above, the first casing member 1 and the second casing member 2 jointly form the expandable power adaptor. To assembly, the first lower piece 12 and the second lower piece 22 are joined to form a complete lower piece through the locking between the first and second lower coupling elements 121 and 221. Then the circuit assembly 4, the metallic connectors 5, and movable elements 6 are configured on the complete lower piece. Then, the first and second upper pieces 11 and 21 are vertically joined to the first and second lower pieces 12 and 22, and bolts are used to secure the connection. A complete power adaptor is thereby formed. To use the expandable power adaptor, the switch 43 is engage to turn on the power conversion module 41. Then appliances can be connected to a USB port 42 or a metallic connector 5. The USB ports 42 provide 5V DC voltage output whereas the metallic connectors 5 provide 110V AC voltage output. Therefore, for safety, each metallic connector 5 is protected by a movable element 6. In the present embodiment, the first casing member 1 provides two metallic connectors 5 and four USB ports 41, and the second casing member 2 provides two metallic connectors 5. Overall, the expandable power adaptor provides up to 4 sockets for AC voltage and 4 USB ports.

As shown in FIGS. 5 to 10, an expandable power adaptor according to another embodiment of the present invention contains the following components.

There is a first casing member 1*a* having a first coupling element set on an inner wall of the first casing member 1*a*.

There is a second casing member 2*a* having a second coupling element set on an inner wall of the second casing member 2*a*.

There is a third casing member 7*a* having a third coupling element set on an inner wall of the third casing member 7*a*. The first, second, and third casing members 1*a*, 2*a*, and 7*a* are joined to form an enclosed accommodation space 3*a*.

There is a circuit assembly 4*a* in the accommodation space 3*a*.

There are metallic connectors 5*a* in the accommodation space electrically connected to the circuit assembly 4*a*.

The first casing member 1*a* contains a first upper piece 11*a* and a corresponding first lower piece 12*a* joined vertically together. The first upper piece 11*a* has at least a first upper coupling element 111*a* on an inner wall of the first upper piece 11*a*. The first lower piece 12*a* has at least a first lower coupling element 121*a* on an inner wall of the first lower piece 12*a*. The first upper and lower coupling elements 111*a* and 121*a* jointly constitute the first coupling element set. The first upper and lower pieces 11*a* and 12*a* are locked together through at least a bolt element.

The third casing member 7*a* contains a third upper piece 71*a* and a corresponding third lower piece 72*a* joined vertically together. The third upper piece 71*a* has at least a third upper coupling element on an inner wall of the third upper piece 71*a*. The third lower piece 72*a* has at least a third lower coupling element and a fourth lower coupling element on an inner wall of the third lower piece 72*a*. The third upper and lower coupling elements, and the fourth lower coupling element jointly constitute the third coupling element set.

The second casing member 2*a* contains a second upper piece 21*a* and a corresponding second lower piece 22*a* joined vertically together. The second upper piece 21*a* has at least a second upper coupling element 211*a* on an inner wall of the second upper piece 21*a*. The second lower piece 22*a* has at least a second lower coupling element 221*a* on an inner wall of the second lower piece 22*a*. The second upper and lower coupling elements 211*a* and 221*a* jointly constitute the second coupling element set. The second upper and lower pieces 21*a* and 22*a* are locked together through at least a bolt element.

The circuit assembly 4*a* contains a power conversion module 41*a*, at least a Universal Serial Bus (USB) port 42*a* electrically connected to the power conversion module 41*a*, and at least a switch 43*a* for turning on and off the power conversion module 41*a*. There is also at least a movable element 6*a* inside the accommodation space 3*a* corresponding to a metallic connector 5*a* to prevent accidentally plugging something into an outlet and contacting the metallic connector 5*a*.

Figure 5:
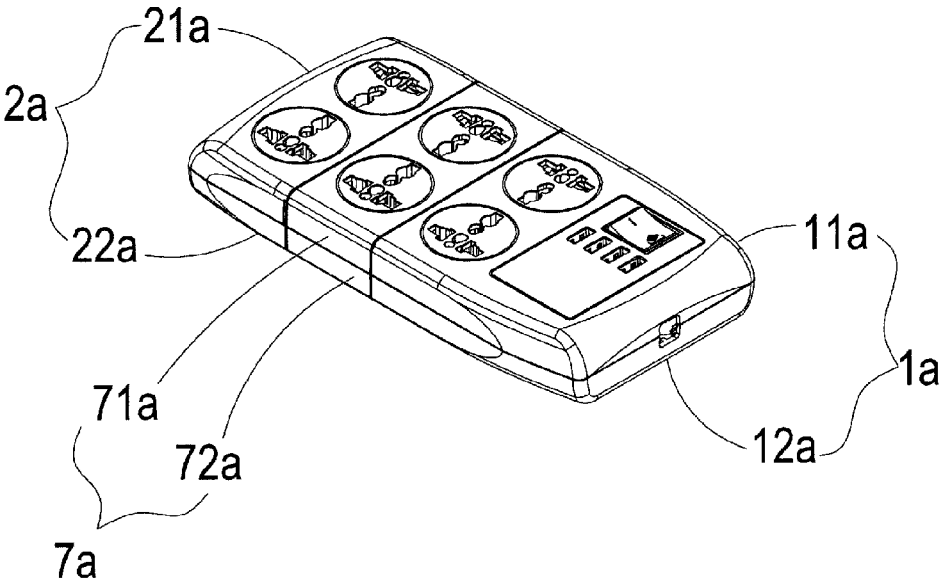
FIG. 5 is a perspective diagram showing an expandable power adaptor according to another embodiment of the present invention.
Figure 6:
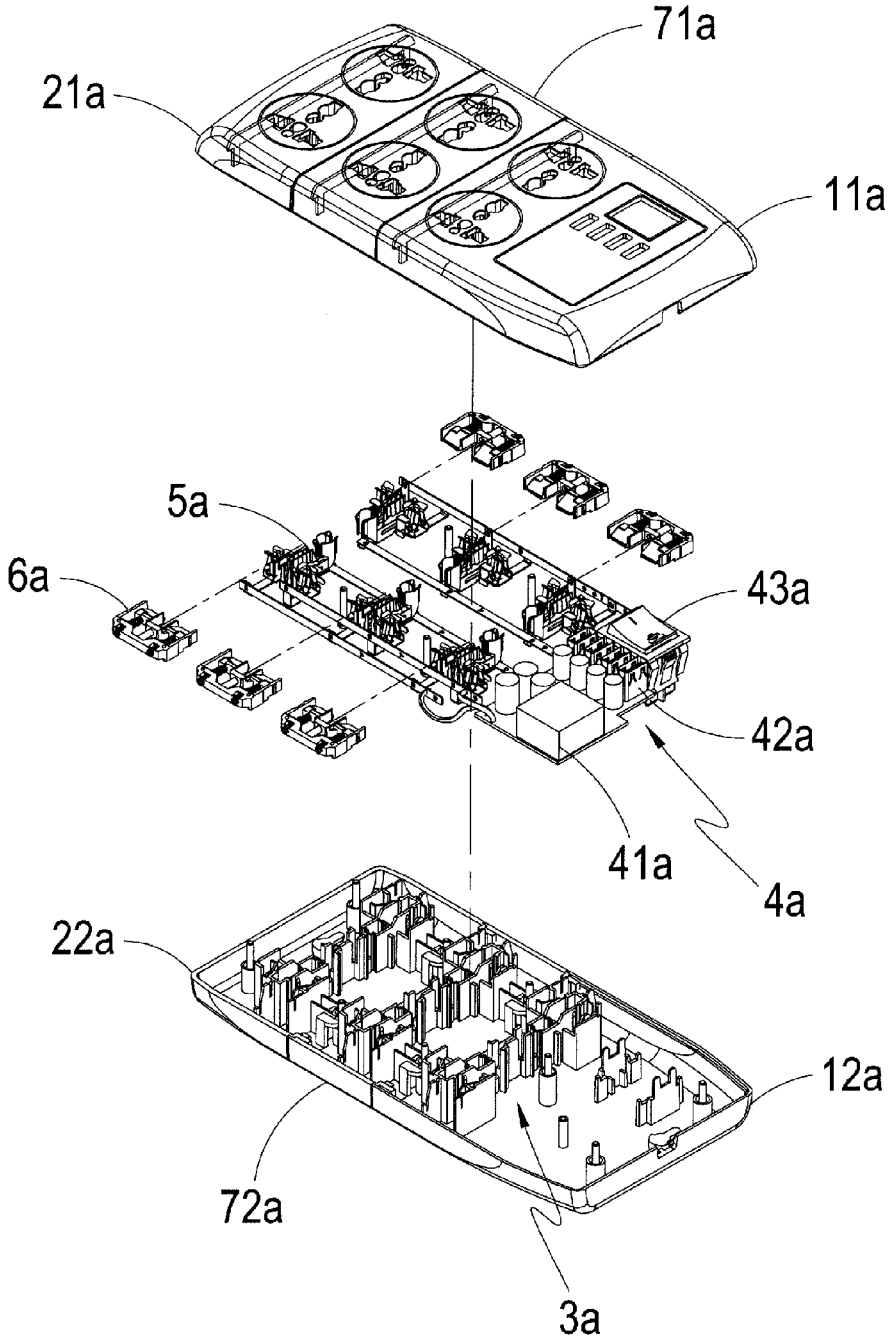
FIG. 6 is a perspective break-down diagram showing the various components of the expandable power adaptor of FIG. 5.
Figure 7:
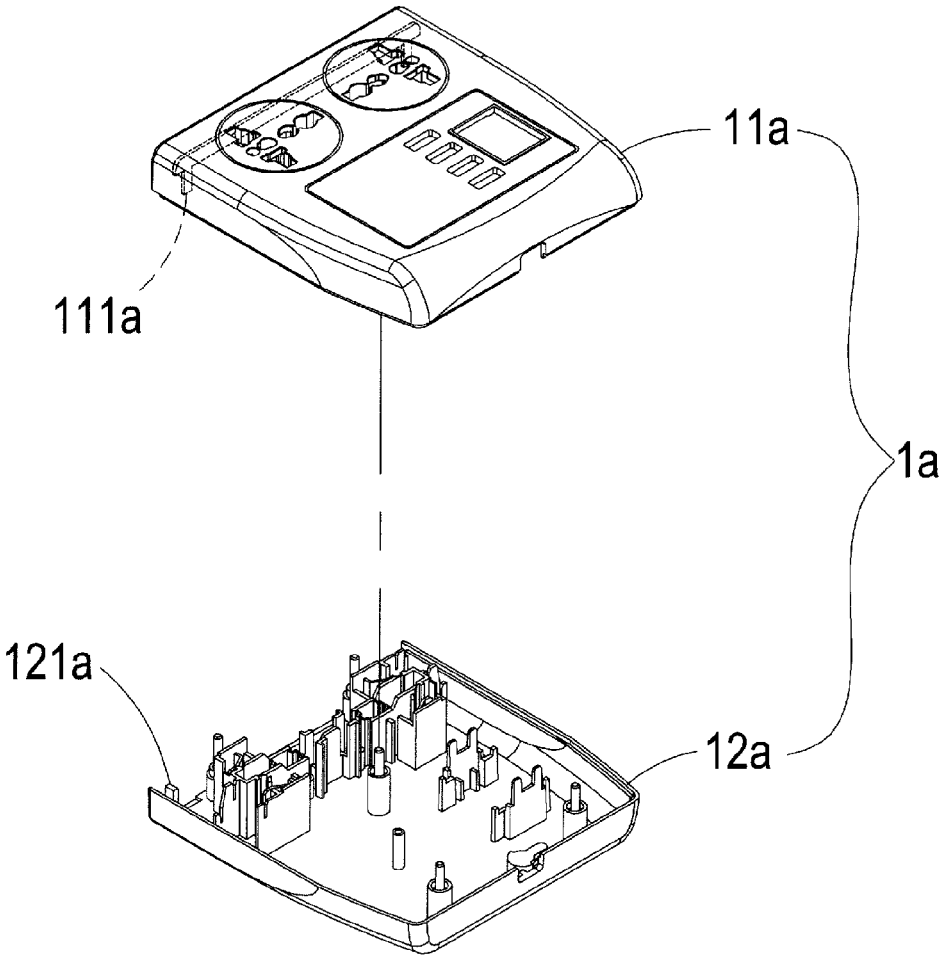
FIG. 7 is a perspective break-down diagram showing a first casing member of the expandable power adaptor of FIG. 5.
Figure 8:
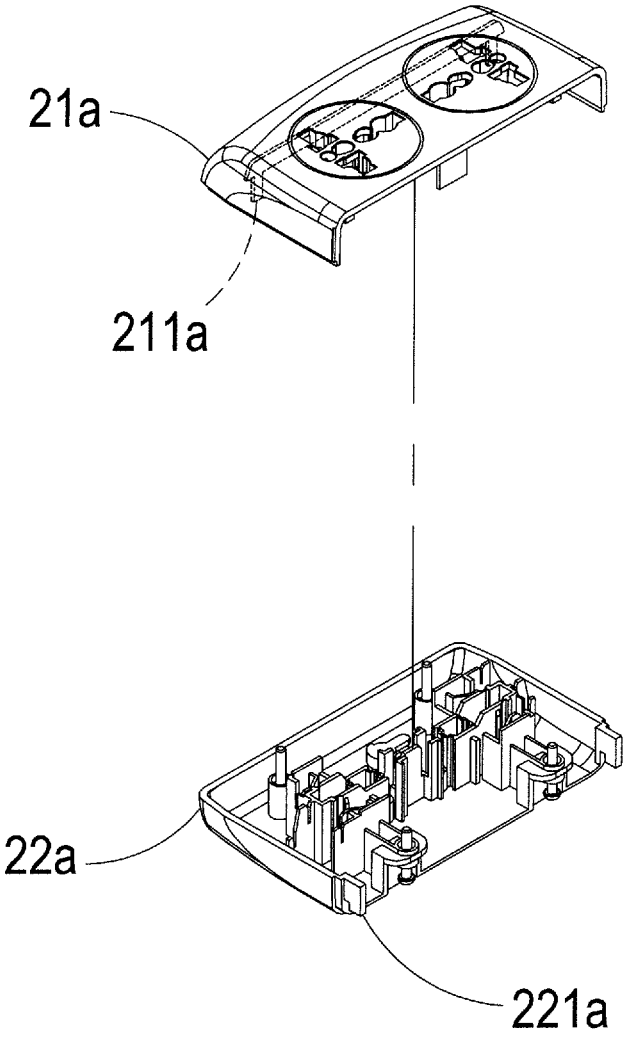
FIG. 8 is a perspective break-down diagram showing a second casing member of the expandable power adaptor of FIG. 5.
Figure 9:
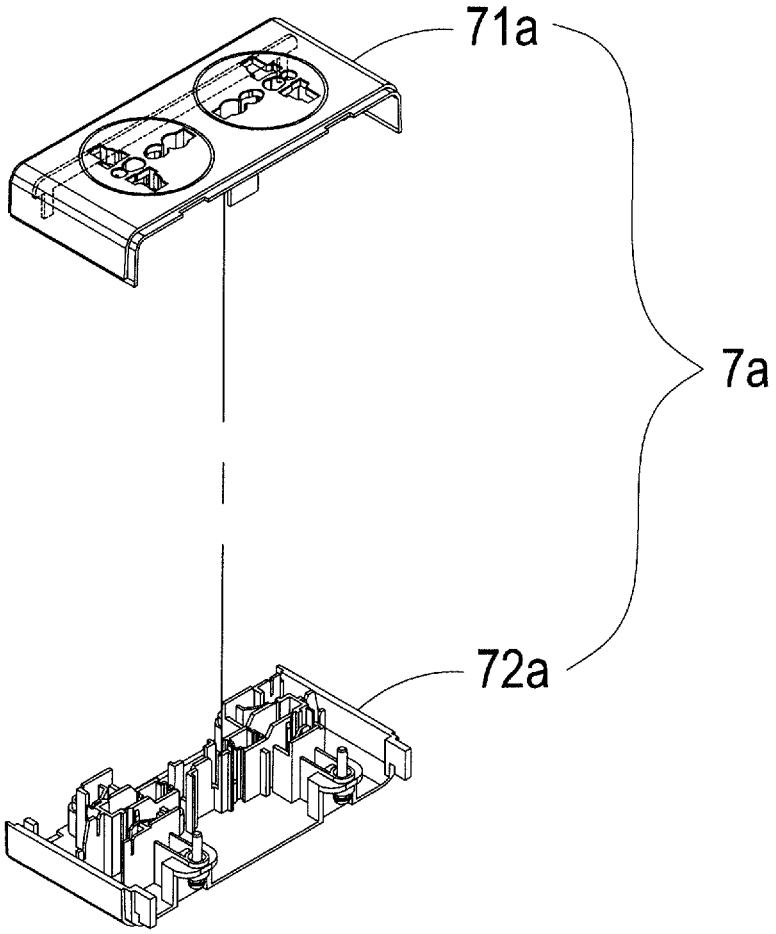
FIG. 9 is a perspective break-down diagram showing a third casing member of the expandable power adaptor of FIG. 5.
Figure 10:
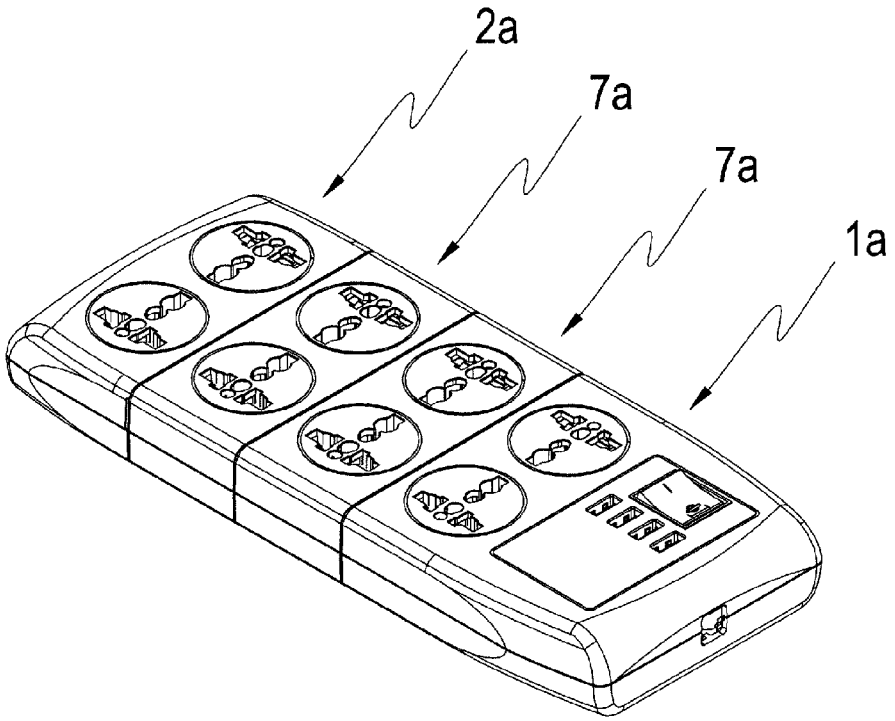
FIG. 10 is a perspective diagram showing an expandable power adaptor according to yet another embodiment of the present invention.

As described above, the first, second, and third casing member 1*a*, 2*a*, and 7*a* jointly form the expandable power adaptor with the third casing member 7*a* sandwiched between the first and second casing members 1*a* and 2*a*. To assembly, the first lower piece 12*a* and the third lower piece 72*a* are joined through the locking between the first lower coupling elements 121*a* and the third lower coupling element. The third lower piece 72*a* and the second lower piece 22*a* are joined through the locking between the fourth lower coupling elements and the second lower coupling element 221*a*. Then a complete lower piece is formed. Then the circuit assembly 4*a*, the metallic connectors 5*a*, and movable elements 6*a* are configured on the complete lower piece. Then, the first, second, and third upper pieces 11*a*, 21*a*, and 71*a* are vertically joined to the first, second, and third lower pieces 12*a*, 22*a*, and 72*a*, and bolts are used to secure the connection. A complete power adaptor is thereby formed. The power adaptor of the present embodiment has adopted identical first and second casing members 1*a* and 2*a* of the previous embodiment. The difference lies in the addition of the third casing member 7*a* and additional metallic connectors 5*a* and movable elements 6*a*. A manufacturer therefore is not required to have different molds for adaptors of different numbers of outlets. The manufacturer also can have a reduced level of inventory. As shown in FIGS. 5 and 10, the embodiment shown in FIG. 10 has an additional third casing member 7*a* than that shown in FIG. 5. Similarly, more third casing members 7*a* can be employed to meet customer need without additional investment in molding and parts.

Therefore, in contrast to the prior art, the prevent invention provides the following advantages.

Firstly, the first and second casing members 1 and 2 provide a most basic configuration for the expandable power adaptor.

Secondly, by integrating appropriate numbers of third casing member 7*a* between the first and second casing members 1*a* and 2*a*, a power adaptor of a desired number of outlets can be achieved conveniently and flexibly.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An expandable power adaptor, comprising:

a first casing member having a first coupling element set on an inner wall of the first casing member;

a second casing member having a second coupling element set on an inner wall of the second casing member, where the first and second casing members are joined to form an enclosed accommodation space;

a circuit assembly comprising a power conversion module, a plurality of Universal Serial Bus (USB) ports electrically connected to the power conversion module, and at least a switch for turning on and off the power conversion module in the accommodation space within the first casing member; and the first and second casing members have a plurality of metallic connectors for AC sockets in the accommodation space within the first and second casing members, respectively, electrically connected to the circuit assembly.

2. The expandable power adaptor according to claim 1, wherein the first casing member comprises a first upper piece and a corresponding first lower piece joined vertically together; the first upper piece has at least a first upper coupling element on an inner wall of the first upper piece; the first lower piece has at least a first lower coupling element on an inner wall of the first lower piece; the first upper and lower coupling elements jointly constitute the first coupling element set; and the first upper and lower pieces are locked together through at least a bolt element.

3. The expandable power adaptor according to claim 2, wherein the second casing member comprises a second upper piece and a corresponding second lower piece joined vertically together; the second upper piece has at least a second upper coupling element on an inner wall of the second upper piece; the second lower piece has at least a second lower coupling element on an inner wall of the second lower piece; the second upper and lower coupling elements jointly constitute the second coupling element set; the second upper and lower pieces are locked together through at least a bolt element; and the first lower piece and the second lower piece are joined through the locking between the first and second lower coupling elements.

4. The expandable power adaptor according to claim 1, wherein at least a movable element is configured inside the accommodation space corresponding to a metallic connector to prevent accidentally plugging an object into an outlet of the expandable power adaptor and contacting the metallic connector.

5. An expandable power adaptor, comprising:

a first casing member having a first coupling element set on an inner wall of the first casing member;

a second casing member having a second coupling element set on an inner wall of the second casing member;

a third casing member having a third coupling element set on an inner wall of the third casing member, where the first, second, and third casing members are joined to form an enclosed accommodation space with the third casing member sandwiched between the first and second casing members;

a circuit assembly comprising a power conversion module, a plurality of Universal Serial Bus (USB) ports electrically connected to the power conversion module, and at least a switch for turning on and off the power conversion module in the accommodation space within the first casing member;

the first, second, and third casing members have a plurality of metallic connectors for AC sockets in the accommodation space within the first, second, and third casing members, respectively, electrically connected to the circuit assembly; and each metallic connector has at least a movable element configured inside the accommodation space to prevent accidentally plugging an object into an AC socket corresponding to a metallic connector and contacting the metallic connector.

6. The expandable power adaptor according to claim 5, wherein the first casing member comprises a first upper piece and a corresponding first lower piece joined vertically together; the first upper piece has at least a first upper coupling element on an inner wall of the first upper piece; the first lower piece has at least a first lower coupling element on an inner wall of the first lower piece; the first upper and lower coupling elements jointly constitute the first coupling element set; and the first upper and lower pieces are locked together through at least a bolt element.

7. The expandable power adaptor according to claim 6, wherein the second casing member comprises a second upper piece and a corresponding second lower piece joined vertically together; the second upper piece has at least a second upper coupling element on an inner wall of the second upper piece; the second lower piece has at least a second lower coupling element on an inner wall of the second lower piece; the second upper and lower coupling elements jointly constitute the second coupling element set; and the second upper and lower pieces are locked together through at least a bolt element.

8. The expandable power adaptor according to claim 7, wherein the third casing member comprises a third upper piece and a corresponding third lower piece joined vertically together.

* * * * *